United States Patent [19]

Boyd

[11] 4,274,216

[45] Jun. 23, 1981

[54] WINE LIST DISPLAY CONTAINER APPARATUS

[76] Inventor: Ron V. Boyd, 1318 Montegut St., New Orleans, La. 70117

[21] Appl. No.: 118,442

[22] Filed: Feb. 4, 1980

[51] Int. Cl.[3] ..... G09F 19/00

[52] U.S. Cl. ..... 40/306; 40/19; 40/124; 40/324; 40/538

[58] Field of Search ..... 40/306, 307, 19, 19.5, 40/10 D, 10 R, 152, 152.1, 538, 324, 325, 124; 206/425; 220/4 B, 4 E

[56] References Cited

U.S. PATENT DOCUMENTS

| | | | |
|---|---|---|---|
| 396,224 | 1/1889 | Mueller | 40/324 |
| 620,868 | 3/1899 | Goebler | 40/538 |
| 2,020,343 | 11/1935 | Willing | 40/307 X |
| 3,469,813 | 9/1969 | Rizzi | 40/324 X |
| 4,111,341 | 9/1978 | Carrozo | 40/10 R |

*Primary Examiner*—John F. Pitrelli

*Attorney, Agent, or Firm*—Keaty & Garvey

[57] ABSTRACT

A wine list display container provides a horizontal barrel having a horizontal division cut therethrough providing bisymmetrical upper lid and lower base portions, each having coinciding mating face portions. At least one hinge is provided for connecting the upper and lower base portions together in a hinged fashion, the lid being movable on the hinges between closed and open positions. A pair of spaced feet are attached to the base for securely supporting the horizontal barrel on a flat surface, such as a table. An inner rack mounted within the barrel and on the barrel base supports a plurality of substantially equally sized information cards which can contain for example individual information on differing wines. A plurality of equally sized information cards are provided which removably and temporarily can be attached to the rack within the barrel with the cards and the rack being contained within the barrel when the lid assumes a closed position with the face portions mating.

1 Claim, 3 Drawing Figures

WINE LIST DISPLAY CONTAINER APPARATUS

BACKGROUND OF THE INVENTION

1. Field of the Invention

The present invention relates to a wine list display container, and more particularly relates to a wine list having a barrel shape and having an inner rack for storing individual cards containing wine list information on the rack with the entire rack and card assembly being contained within the barrel when closed.

2. Background and Prior Art

Many establishments across the country carry wine lists for their customers as well as different wines for consumption. Since wines are often imported, and come from a variety of sources, the wine list can change regularly presenting the shop owner or bar owner with problems regarding the currentness or updating of his wine list. Further, prices fluctuate greatly on wines and the wine list can be updated very quickly as shipments arrive of different wines from different sources. Often the wine list is not updated properly, and the customer is charged a lesser price than is correct, with the owner loosing money on the purchase.

3. General Discussion of the Present Invention

The present invention solves these prior art problems and shortcomings in a simple and inexpensive manner. The present invention provides a wine list display container having a horizontal barrel with a horizontal division cut therethrough providing bisymmetrical upper lid and lower base portions having coinciding mating face portions. Hinges are provided connecting the upper lid and lower base portions with the lid being movable between closed and open positions. A pair of base feet are spaced and connected to the base portion of the barrel for supporting the horizontal barrel on a flat surface, such as a dinner table. An inner rack is mounted within the barrel for supporting a plurality of substantially equally sized information cards. A plurality of equally sized information cards temporarily an removably attached to the rack are provided within the barrel, with the cards and the rack being contained within the barrel when the lid assumes a closed position with the face portions mating. The present invention solves the prior art problems and shortcomings by providing cards which are temporarily and easily removable from their attachment to the rack, which allows the bar owner or restaurant owner to easily update and amend his wine list. Further, the barrel container provides an aesthetically pleasing container in that the barrel shape is associated with wine. Further, the device can be easily placed on a dinner table notwithstanding the round shape of the barrel as base feet are provided having lower flat surfaces for securely supporting the horizontal barrel on a flat surface such as a dinner table. The removable cards allow individual cards to be circulated among patrons at the dinner table for individual close-up inspection.

Thus, it is an object of the present invention to provide an aesthetically pleasing wine list display container having a wine barrel shape.

It is further object of the present invention to provide a wine list display container which can be easily placed on flat surfaces such as restaurant tables.

It is another object of the present invention to provide a wine list display container with individually removable wine list information cards.

BRIEF DESCRIPTION OF THE DRAWINGS

For a further understanding of the nature and objects of the present invention, reference should be had to the following detailed description, taken in conjunction with the accompanying drawings, in which like parts are given like reference numerals and wherein.

DETAILED DESCRIPTION OF THE PREFERRED EMBODIMENT

Figure 1:
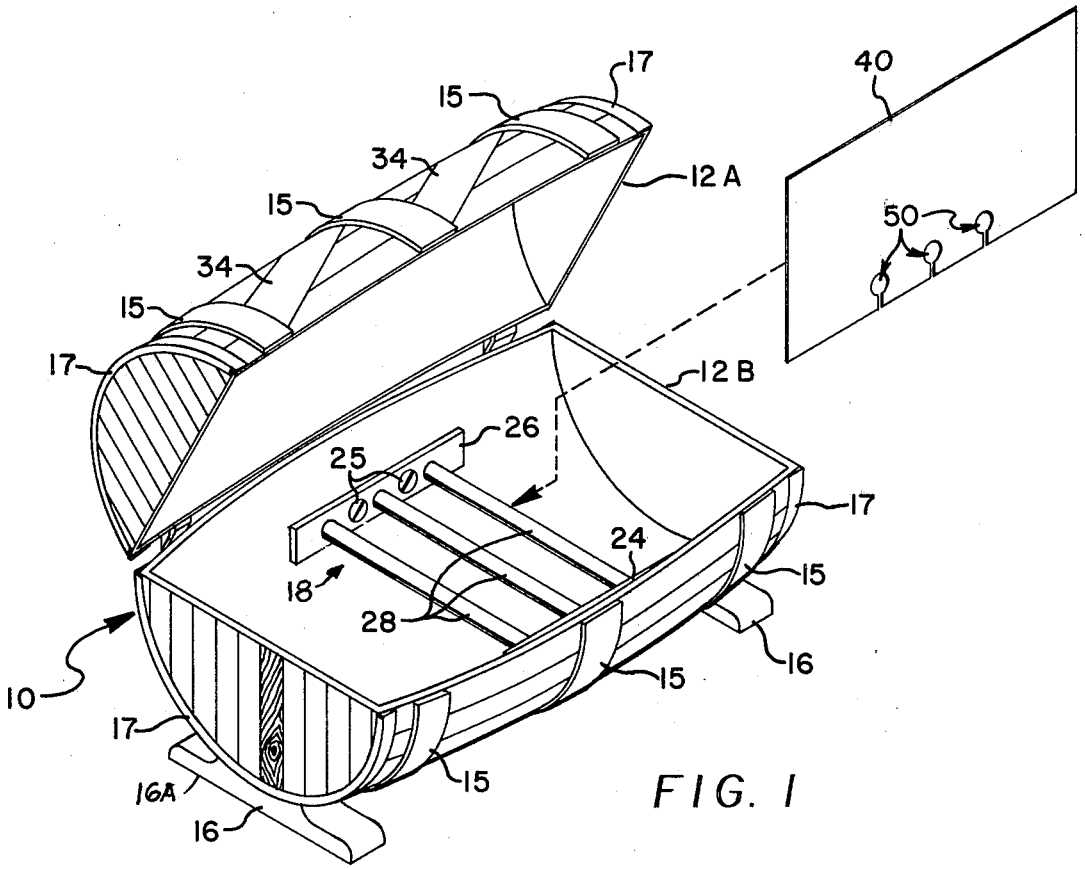
FIG. 1 is a perspective view of the preferred embodiment of the apparatus of the present invention.
Figure 2:
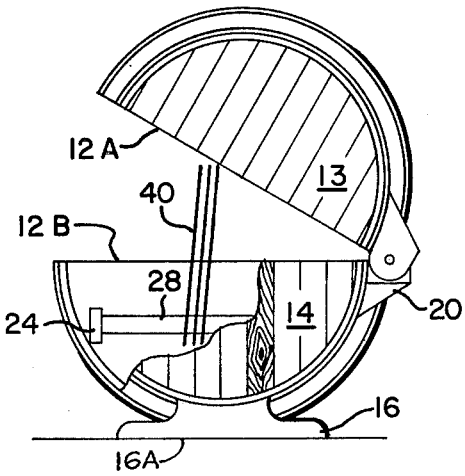
FIG. 2 is a sectional view taken along lines 2 to FIG. 1.
Figure 3:
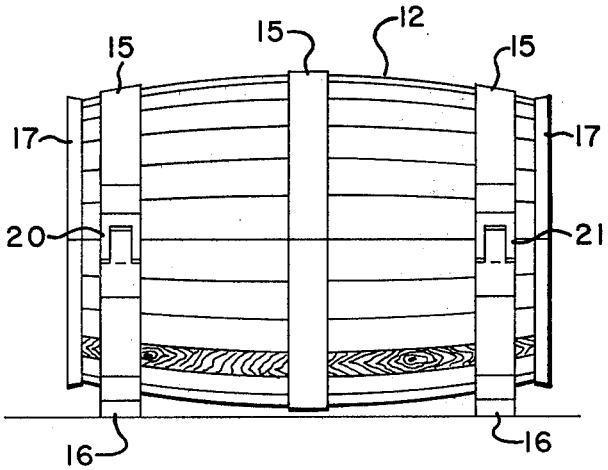
FIG. 3 is a rear view of the preferred embodiment of the apparatus of the present invention.

FIGS. 1–3 illustrate the preferred embodiment of the apparatus of the present invention designated generally by the numeral 10. Wine list 10 provides a barrel container 12 having a horizontal cut therethrough forming an upper lid 13 and a lower base 14. Mating cooperative coinciding mating surfaces **12*a*, 12*b*** are provided.

The base portion 14 provides a pair of spaced feet 16 having lower flattened surfaces **16*a*, which allow and adapt barrel 12 for placement on flat surfaces, such as dinner tables and the like. A plurality of circular circumventing intermediate straps 15 are provided which are decorative and indicate metallic straps as are provided on conventional barrels. In a like manner, circular circumferential end straps 17 are provided at the end portions of barrel 12**.

An inner rack 18 is provided having a fore mounting bracket 24 and an aft mounting bracket 26, which can be attached to the base 14 by mounting screws 25 for example. A plurality of card holding shafts 28 connect fore and aft mounting brackets 24, 26 with cards 40 being attached thereto. A plurality of individual cards 40 are provided to provide a card deck supported by shafts 28 mounted on openings 50.

Lid 13 an base 14 are hingedly connected using hinges 20, 21.

A label 34 can be provided as desired.

The barrel 12 can be manufactured of any suitable material, such as wood, plastic, metal, or the like. An inner lining of felt could be provided of any color if desired. Hinges 20, 21, straps 15, 17, and feet 16 could all be provided of any suitable structural material such as metal, plastic, or the like.

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed as invention is:

1. A wine list display container comprising:

a. a horizontal barrel having a horizontal division cut therethrough providing bisymmetrical upper lid and lower base portions, having coinciding mating face portions;

b. hinge means for connecting said upper lid and lower base portions, said lid being movable between closed and open positions;

c. base feet means on said base for securely supporting said horizontal barrel on a flat surface, such as a dinner table;

d. inner rack means within said barrel for supporting a plurality of substantially equal sized information cards; and e. a plurality of equally sized information cards temporarily and removably attachable to said rack within said barrel, said cards and said rack being contained within said barrel when said lid assumes a closed position with said face portions mating.

* * * * *